US007450890B2

(12) United States Patent
Murakami et al.

(10) Patent No.: US 7,450,890 B2
(45) Date of Patent: Nov. 11, 2008

(54) DEVELOPER SUPPLY CONTAINER HAVING A SHUTTER CLEANING FEATURE

(75) Inventors: Katsuya Murakami, Toride (JP); Nobuo Nakajima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 108 days.

(21) Appl. No.: 11/262,777

(22) Filed: Nov. 1, 2005

(65) Prior Publication Data

US 2006/0104671 A1 May 18, 2006

(30) Foreign Application Priority Data

Nov. 12, 2004 (JP) ..... 2004-328682

(51) Int. Cl.
*G03G 15/08* (2006.01)

(52) U.S. Cl. ..... 399/258; 399/260; 399/262

(58) Field of Classification Search ..... 399/258, 399/259, 260, 261, 262; 222/DIG. 1
See application file for complete search history.

(56) References Cited

U.S. PATENT DOCUMENTS

| | | | | |
|---|---|---|---|---|
| 5,630,198 | A | 5/1997 | Makino | 399/120 |
| 5,678,147 | A | 10/1997 | Makino | 399/263 |
| 5,697,014 | A | 12/1997 | Makino | 399/65 |
| 5,761,585 | A | 6/1998 | Makino | 399/262 |
| 5,771,427 | A | 6/1998 | Makino | 399/120 |
| 6,510,306 | B2 | 1/2003 | Ashikari | |
| 7,006,779 | B2 * | 2/2006 | Otani | 399/258 |
| 2002/0064401 | A1 * | 5/2002 | Ashikari | 399/258 |
| 2005/0135841 | A1 | 6/2005 | Murakami et al. | 399/258 |

FOREIGN PATENT DOCUMENTS

| | | |
|---|---|---|
| CN | 1356600 A | 7/2002 |
| EP | 1 211 570 A2 | 5/2002 |
| JP | 10-55103 | 2/1998 |

OTHER PUBLICATIONS

Notification of the First Office Action, dated Nov. 23, 2007, issued in Chinese counterpart Application No.: 200510119416.6, and an English-language translation thereof.

* cited by examiner

*Primary Examiner*—Hoang Ngo
(74) *Attorney, Agent, or Firm*—Fitzpatrick, Cella, Harper & Scinto

(57) ABSTRACT

A developer supply container is detachably mountable to a developer receiving apparatus having a receiving opening for receiving a developer and a shutter for opening and closing the receiving opening. The developer supply container including an engaging portion provided on a periphery of the developer supply container, and is engageable with the shutter to open and close the shutter with a rotational movement of either the developer supply container mounted in the developer receiving apparatus or a rotatable container body; and a cleaning member, provided on a periphery of the developer supply container for cleaning the shutter with the rotational movement of the developer supply container.

17 Claims, 13 Drawing Sheets

(a)

(b)

(a)

(b)

(a)

(b)

ENLARGED A PORTION (a)

(b)

DEVELOPER SUPPLY CONTAINER HAVING A SHUTTER CLEANING FEATURE

FIELD OF THE INVENTION AND RELATED ART

The present invention relates to a developer supply container for supplying a developer to a developer receiving apparatus for use in a copying machine, a facsimileing machine, a printer, etc.

In the field of such an image forming apparatus as an electrophotographic copying machine, a printer, etc., a developer in the form of extremely minute particles has been used conventionally, and it has been a common practice that when the toner in the main assembly of an image forming apparatus is depleted by consumption, a toner supply container is used to supply the image forming apparatus with developer. However, since the developer is very fine powder, there has been a possibility that during an operation for supplying an image forming apparatus with developer, the developer scatters. For this reason, such a method that a developer supply container is disposed in a main assembly of an image forming apparatus and a developer is supplied from a small opening little by little has been proposed and put into practical use.

For example, Japanese Laid-Open Patent Application No. Hei 10-55103 discloses such a constitution that a shutter provided to a developer receiving opening of a developing apparatus is opened and closed by rotation of a developer supply container. More specifically, both ends of the shutter of the developing apparatus are held by projections disposed on a peripheral surface of the developer supply container at the time when the developer supply container is mounted. In this state, by rotating the developer supply container, the shutter is moved while being opened or closed. In such a constitution, by the rotation of the developer supply container, there is possibility that the developer enters a space formed after the shutter passes therethrough, during a developer supply operation.

Further, in the above described constitution, the shutter of the developing apparatus is moved (opened or closed) together with the developer supply container from an initial stage of the rotation of the developer supply container, so that then is also a possibility that an outer surface of the developer supply container is contaminated due to the developer deposited on the shutter.

SUMMARY OF THE INVENTION

An object of the present invention is to provide a developer supply container capable of suppressing a contamination of a shutter of a developer receiving apparatus with developer.

Another object of the present invention is to provide a developer supply container capable of suppressing a contamination of an outer surface of the developer supply container with developer.

According to an aspect of the present invention, there is provided a developer supply container detachably mountable to a developer receiving apparatus having a receiving opening for receiving a developer and a shutter for opening and closing the receiving opening, the developer supply container comprising:

an engaging portion which is engageable with the shutter and movable to open and close the shutter by movement of the developer supply container; and a cleaning member for cleaning the shutter when the developer supply container is moved relative to the shutter between a removal position permitting removal of the developer supply container from the developer receiving apparatus and a supply position at which the developer is supplied from the developer supply container to the developer receiving apparatus.

According to another aspect of the present invention, there is provided a developer supply container detachably mountable to a developer receiving apparatus having a receiving opening for receiving a developer and a shutter for opening and closing the receiving opening, the developer supply container comprising:

a contained body for containing the developer;

a discharge opening permitting discharge of the developer contained in the container body;

an engaging portion which is engageable with the shutter and movable to open and close the shutter by movement of the developer supply container; and a cleaning member for cleaning the shutter when the developer supply container is moved relative to the shutter between a removal position permitting removal of the developer supply container from the developer receiving apparatus and a communicating position at which the discharge opening communicates with the receiving opening.

According to a further aspect of the present invention, there is provided a developer supply container detachably mountable to a developer receiving apparatus having a receiving opening for receiving a developer and an apparatus shutter for opening and closing the receiving opening, the developer supply container comprising:

a container body for containing the developer; and a sliding member which is disposed at an outer peripheral surface of aid container body and slides on the apparatus shutter by movement thereof relative to the apparatus shutter.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, an image forming apparatus which is supplied with a developer for developer supply container according to embodiments of the present invention will be described before the developer supply container is explained.

First Embodiment

<Image Forming Apparatus>

First, referring to FIG. 1, an electrophotographic copying machine, as an example of an electrophotographic image forming apparatus in which a developer supply container according to First Embodiment of the present invention is mounted, will be described with regard to its constitution.

Figure 1:
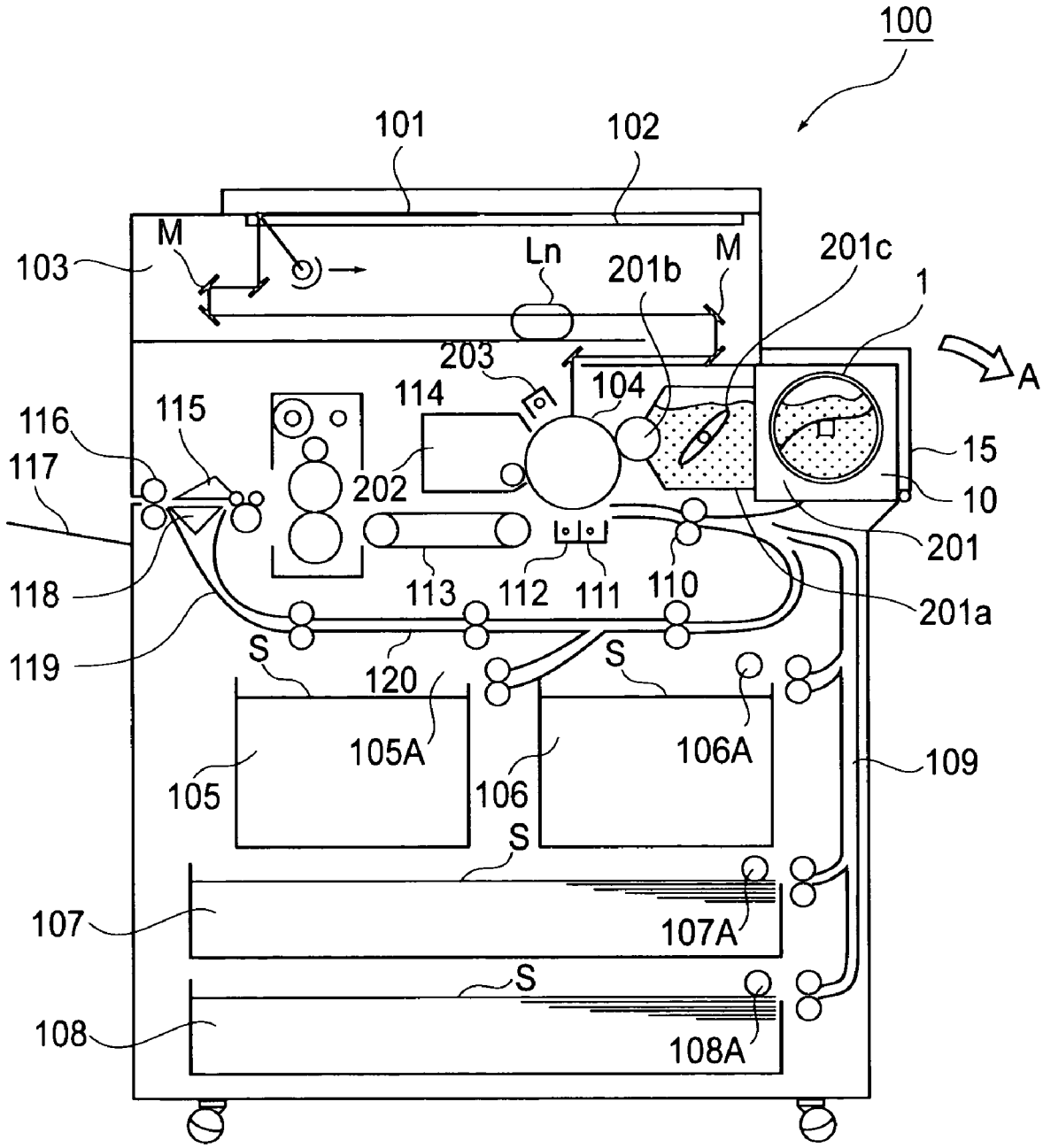
FIG. 1 is a schematic sectional view showing a constitution of an electrophotographic copying machine as an example of an electrophotographic image forming apparatus used in the present invention.

In FIG. 1, designated by a referential number 100 is the main assembly of the electrophotographic copying machine (hereinafter referred to as an "apparatus main assembly"). Designated by a referential number 101 is an original, which is placed on an original-supporting glass plate 102. An optical image in accordance with the image formation (data) is formed on the electrophotographic photosensitive drum 104 by the combination of a plurality of mirrors M and a plurality of lenses Ln. Designated by referential numbers 105-108 are cassettes, from among which the cassette containing recording mediums (hereinafter referred to as "sheets") S, which agree in size with the information inputted by an operator through the control panel, or are the most suitable to the size of the original 101, is selected, based on the information regarding the sizes of the sheets in the cassettes 105-108. The recording medium does not need to be limited to paper. For example, an OHP sheet or the like may be selected appropriately.

The sheets S are conveyed one by one by separating and conveying apparatuses 105A-108A, to a pair of registration rollers 110 by way of a sheet conveyance path 109. Then, each sheet S is conveyed further by the pair of registration rollers 110 in synchronism with the rotation of the photosensitive drum 104 and the scanning timing of the optical portion 103. Designated by referential numbers 111 and 112 are a transfer discharger for transferring an image formed with developer on the photosensitive drum 104, onto the sheet S, and a separation discharger for separating the sheet S from the photosensitive drum 104 after the transfer of the developer image onto the sheet S, respectively.

Thereafter, the sheet S is further conveyed by a sheet conveying portion 113 to the fixation station 114, in which the developer image on the sheet S is fixed by heat and pressure. Then, when the copying machine is in the single-sided print mode, the sheet S is moved through the reversing station, without being placed upside down, and is discharged into the delivery tray 117 by a pair of discharge rollers 116. When the machine is in the two-sided print mode, a flapper 118 of the reversing station 115 is controlled so that the sheet S is conveyed to the pair of registration rollers 110 by way of re-feeding conveyance paths 119 and 120. Then, the sheet S is made to move through the same paths as those through which the sheet S is moved when the machine is in the single-sided print mode, and is discharged into the delivery tray 117.

When the machine is in the multilayer print mode, the sheet S is sent through the reversing station 115 so that it is stopped after it is partially extended outward from the main assembly by the pair of discharge rollers 116. More specifically, it is stopped immediately after the trailing edge of the sheet S is moved past the flapper 118, while the sheet S is remaining pinched by the pair of discharge roller 116. Then, the flapper 118 is switched in position, and the pair of discharge rollers 116 are rotated in reverse so that the sheet S is conveyed back into the main assembly. Thereafter, the sheet S is conveyed to the registration rollers 110 through paper re-conveyance paths 119 and 120. Then, it is moved through the same paths as those through it is moved when the machine is in the single-side print mode, and discharge into the delivery tray 117.

In the main assembly 100 of the copying machine structured as described above, a developing apparatus 201, a cleaner portion 202, a primary charger 203, etc., are disposed in around the peripheral surface of the photosensitive drum 104. The cleaner portion 202 is where the developer remaining on the peripheral surface of the photosensitive drum 104 is removed. The primary charger 203 is for charging the photosensitive drum 104.

<Developing Apparatus?

The developing apparatus 201 is an apparatus in which the electrostatic latent image formed on the peripheral surface of the photosensitive drum 104 by the optical portion 103, based on the image formation data extracted from the original 101, is developed with the use of developer. The developer supply container 1 for supplying this developing apparatus 201 with developer is to be removably mounted in the main assembly 100 of the copying machine by a user.

The developing apparatus 201 comprises a developer receiving apparatus in which the developer supply container 1 is removably mounted, and a developing device 201*a*. Further, the developing device 201*a* comprises a development roller 201*b* and a developer conveying member 201*c*. After being supplied from the developer supply container 1 into the developer receiving apparatus, the developer is sent by the conveying member 201*c* to the development roller 201*b*, by which the developer is supplied to the photosensitive drum 104.

Figure 2:
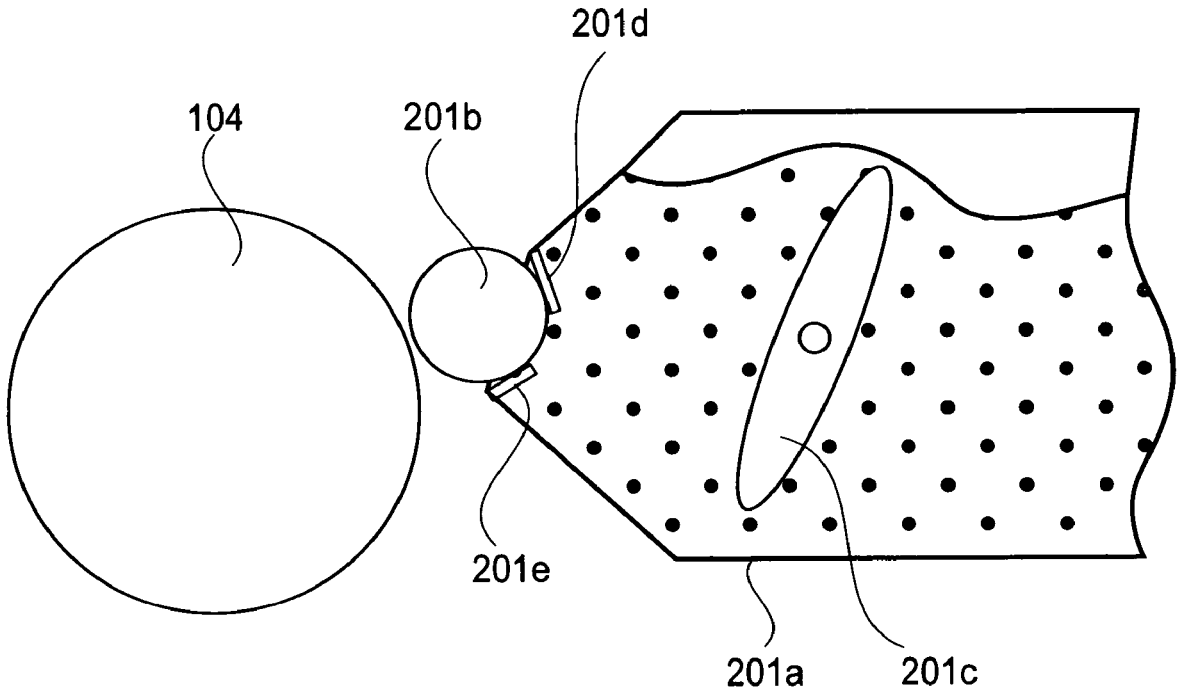
FIG. 2 is a schematic partial sectional view showing a constitution of a developing apparatus used in an embodiment of the present invention.

Incidentally, the development roller 201*b* is, as shown in FIG. 2, provided with a developing blade 201*d* as a regulation member for regulating a coating amount of developer on the roller and a leakage prevention sheet 201*e* as a developer leakage preventing member disposed in contact with the development roller in order to prevent the leakage of developer located between the developing device 201*a* and the leakage prevention sheet 201*e*.

Further, as shown in FIG. 1, the main assembly 100 is provided with a cover 15 for the replacement of a developer supply container, which constitutes a part of the external shell of the main assembly 100, and which is opened in the direction indicated by an arrow A in FIG. 1, when a user mounts the developer supply container 1 into the apparatus main assembly 100 or removes it therefrom.

<Developer Supply Container>

Next, referring to FIGS. 3(*a*)-3(*d*), the display supply container 1 in this embodiment will be described regarding its constitution.

A container body 1*a* of the developer supply container 1, in which developer is stored, is a hollow and roughly cylindrical member. A peripheral surface of the container body 1*a* is provided with a developer supply opening 1*b* for supplying the developer to the developing apparatus, which is roughly in the form of a slit, the longer edges of which are parallel to the lengthwise direction of the container body 1*a*. Further, at the peripheral surface of the container body 1*a*, a snap-lock portion 6 as an engaging portion for being engageable with an apparatus shutter 8 of the developer receiving apparatus 7 (FIGS. 4(*a*)-4(*c*)) so as to be movable to open or close the apparatus shutter 8 by rotation of the developer supply container 1. BY disposing the snap-lock portion at both end sides of the container body in the lengthwise direction thereof, yawing of the apparatus shutter during movement for open or closure is prevented. The snap-lock portion is integrally formed of the container body and resin, so that it is constituted so as to be connected with the engaging portion of the apparatus shutter by utilizing its elastic force. Further, as described later, a strength of the snap-lock portion is set to provide an elastic force to the extent that it can be separated from the engaging portion of the apparatus shutter. Incidentally, by adopting a snap-lock type member as the engaging portion provided to the container body, both the opening and re-closure of the apparatus shutter can be performed but the present invention is not limited only to such a constitution. For example, it is also possible to employ a link-type constitution utilizing an urging spring or a constitution in which engaging projections for open and re-closure of the apparatus shutter 8 are separately provided. The container body 1*a* is also provided with a developer filling opening 1*c*, which is a part of one of the lengthwise end walls of the container body 1*a*, and which is sealed with an unshown sealing member or the like after the filling of the container body 1*a* with developer. The developer supply container 1 is also provided with a handle 2, which is to be grasped by a user in a supply operation of the developer supply container 1. The handle 2 is anchored to the lengthwise ends of the developer supply container 1.

Figure 3:
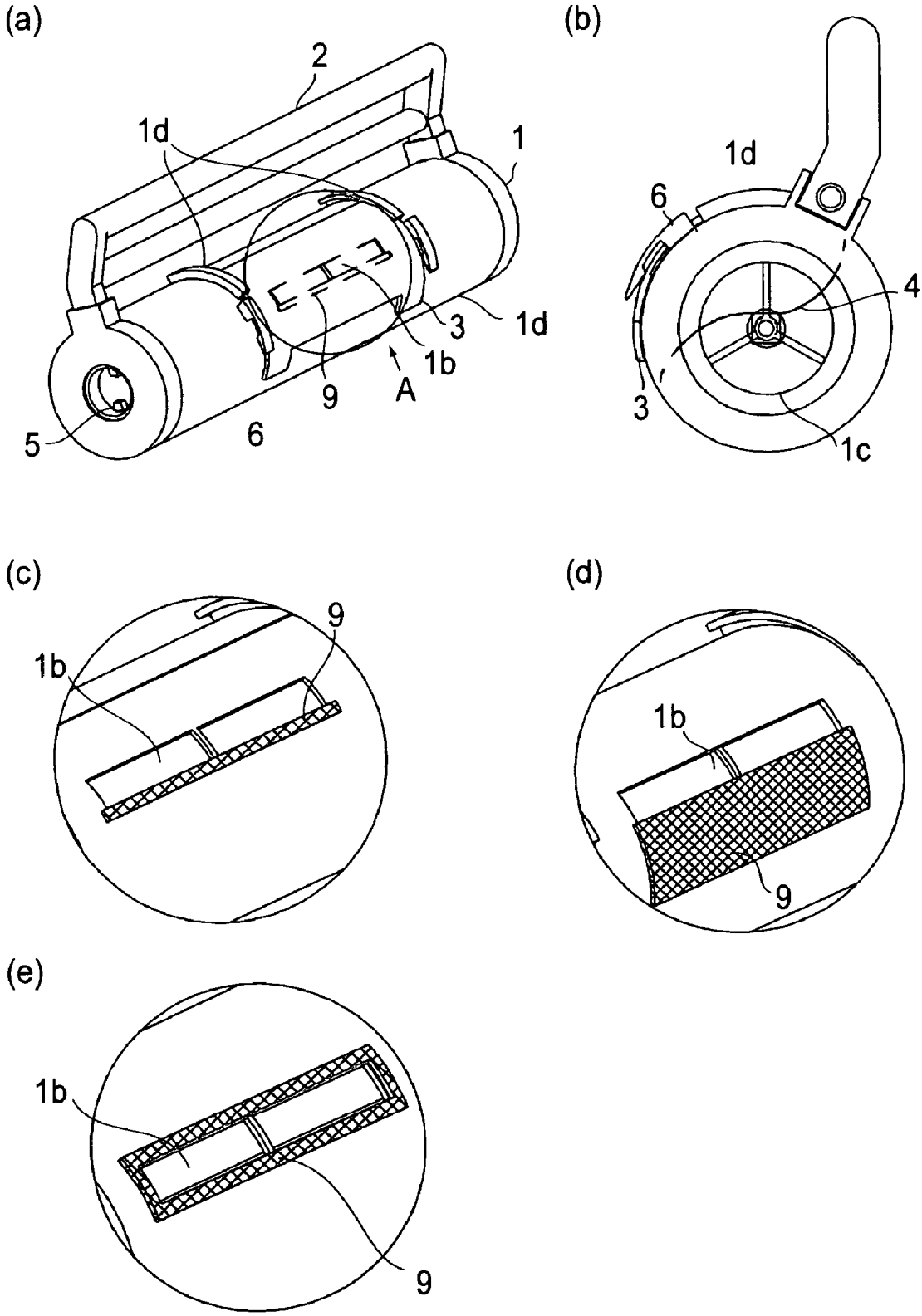
FIGS. 3(*a*) and 3(*b*) are perspective and side views, respectively, of a developer supply container in First Embodiment of the present invention, and FIGS. 3(*c*), 3(*d*) and 3(*e*) are respectively an enlarged view of the portion A (from which a container shutter 3 is omitted) in FIG. 3(*b*).

Referring to FIG. 3(*a*), the developer supply opening 1*b* is kept sealed by the container shutter 3 having such a shape that it extends along the outer peripheral surface (wall) of the developer supply container 1. The container shutter 3 is engaged with a pair of guiding members 1*d* located at the length-wise ends of the developer supply opening 1*b*, being allowed to slide along the peripheral surface of the container body 1*a* in the circumferential direction thereof to cover the developer supply opening 1*b* which can be opened or closed.

Further, the developer supply container 1 of this embodiment is, as shown in FIGS. 3(*a*) and 3(*c*), provided with a sealing member 9 as a cleaning member slidably disposed with respect to the apparatus shutter in the neighborhood of the developer supply opening 1*b* of the container body 1*a*. The sealing member 9 is set to have a length in its lengthwise direction so that it is longer than a width (length) of the developer supply opening 1*b* in the lengthwise direction. Further, the sealing member is provided, to the container body 1*a*, upstream from the developer supply container 1*b* in a rotational movement direction of the developer supply container from the supply position to the removal position as described later. Further, when the developer supply container 1 is mounted into the developer receiving apparatus 7 to be placed in a developer-suppliable state, the sealing member 9 is disposed to cover a gap between the developer supply container 1 and the developer receiving apparatus 7. As a result, it becomes possible to prevent the developer from entering the gap between the developer supply container 1 and the developer receiving apparatus 7.

Further, the sealing member 9 is disposed slidably with respect to the apparatus shutter 8 during the rotational movement operation of the developer supply container 1. Incidentally, in the case of improving a wiping and holding function of the sealing member 9 with respect to the developer, as shown in FIG. 3(*d*), it is preferable that a mounting area of the sealing member 9 is increased as large as possible. However, as shown in FIG. 3(*a*), when the covering of the sealing member 9 with the container shutter 3 in such a state that the developer supply opening 1*b* is covered with the container shutter 3 is taken into account, the sealing member may preferably be set to have an appropriate size. More specifically, as described later, a contaminated sealing member can be covered with the container shutter 3 by wiping developer deposited in a slight amount on the apparatus shutter. As a result, it becomes possible to prevent contamination with the developer due to touch of the sealing member by the user.

Further, the sealing member 9 may more preferably be constituted so as to surround the developer supply opening 1*b* as shown in FIG. 3(*e*) in view of ensuring of covering performance thereof during the discharge of the developer.

The material for the sealing member 9 may preferably have a low density when the sliding pressure of the sealing member 9 with the apparatus shutter 9 is taken into consideration. More specifically, examples thereof may include foam such as urethane form having a low degree of forming; woven or nonwoven fabric comprising, as a base material, animal fibers such as wool and silk, vegetable fibers such as cotton and hemp, or synthetic fibers such as those of nylon, polyester, and acrylic polymer; and the like. Further, the sealing member 9 may preferably be an elastic member which is compressible between the developer supply container 1 and the developer receiving apparatus 7.

The container body 1*a* is provided with a stirring member 4, and a driving gear member 5, which is located at the lengthwise end of the container body 1*a*, opposite to where the developer filling opening 1*c* is located, and which is connected to the stirring member so that the stirring member rotates with the gear member 5. More specifically, the developer supply container 1 is structured so that after the developer supply container mounted in the main assembly of the image forming apparatus is readied for developer discharge, the driving force from the main assembly is transmitted to the stirring member 4 through the gear member 5 in order to rotationally move the stirring member 4 so that the developer within the developer supply container 1 is discharged from the developer supply container 1 through the developer supply opening 1*b* to be supplied into the developing apparatus.

<Developer Receiving Apparatus>

Next, referring to FIGS. 4(*a*)-4(*c*), the developer receiving apparatus 7, as part of the developing apparatus, for receiving the developer from the developer supply container 1 in this embodiment will be described regarding its structure.

The developer receiving apparatus 7 is provided with a semicylindrical (developer supply container) cradle 7*a* in which the developer supply container 1 is removably mounted, and a developer receiving opening 7*b* for receiving the developer discharged from the developer supply container 1 into the developing device (FIG. 2).

The developer receiving apparatus 7 is also provided with the apparatus shutter 8 for freely opening or closing the developer receiving opening 7*b*. The apparatus shutter 8 is in the form of a semicylinder, which extends along the peripheral surfaces of the developer supply container 1 cradle 7*a*. The apparatus shutter 8 is engaged with the pair of guiding members 7*c* located at the lengthwise edges of the developer receiving opening 7*b*, on the underside of the semicylindrical top wall of the cradle 7*a*, so that the apparatus shutter 8 slidably moved in the circumferential direction to freely open or close the developer receiving opening 7*b*.

Figure 4:
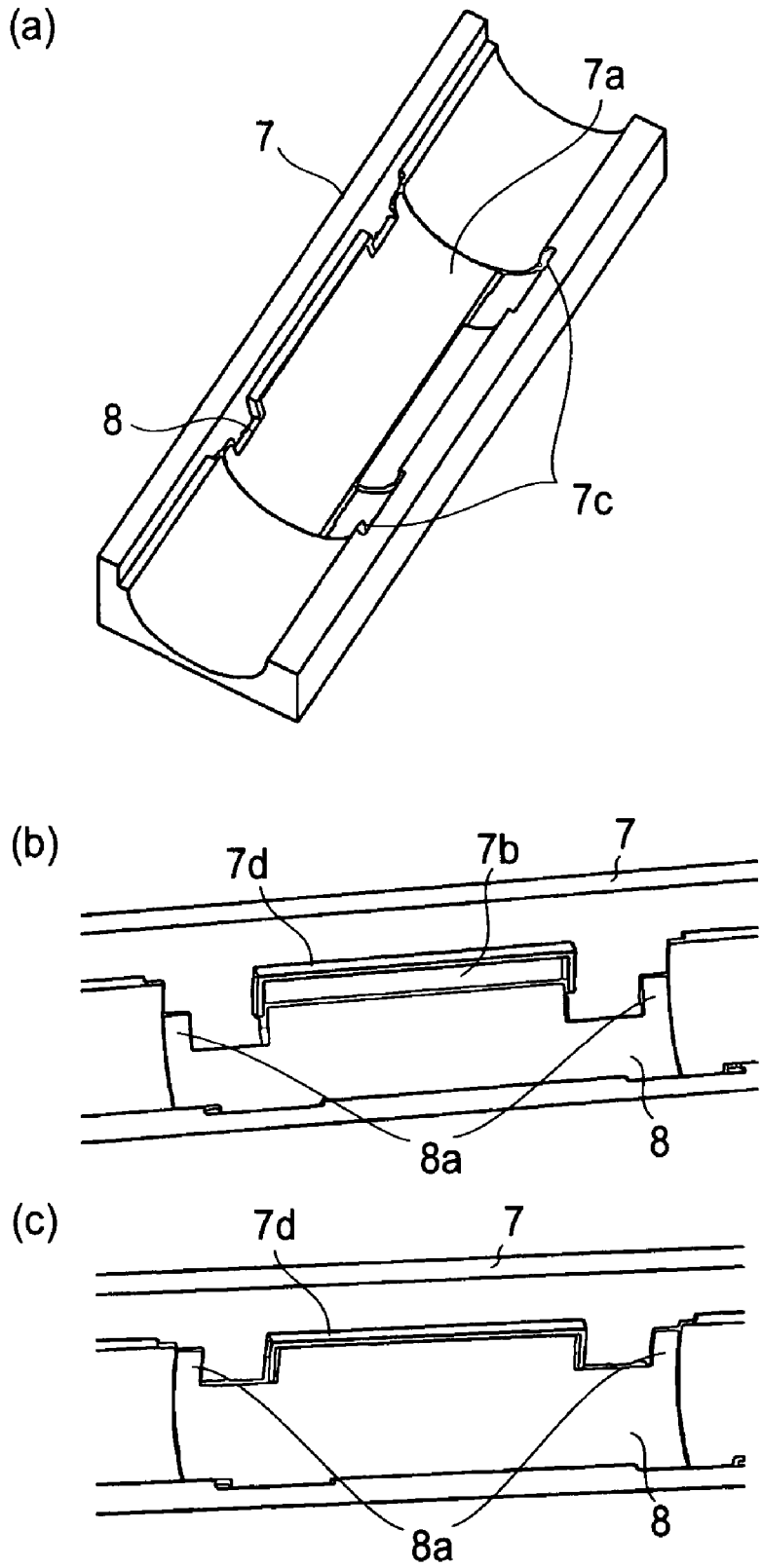
FIGS. 4(*a*), 4(*b*) and 4(*c*) are schematic views of the developer receiving apparatus in First Embodiment of the present invention, wherein 4(*a*) is a perspective view, 4(*b*) is a perspective view during open of a developer supply opening, and 4(*c*) is a perspective view during closure of the developer supply opening.

When the developer supply container 1 is not mounted in the cradle 7*a*, the apparatus shutter 8 is in the position, shown in FIG. 4(*c*), in which the edge of the apparatus shutter 8 is in contact with a stopper 7*d* provided to the developer receiving apparatus 7, keeping thereby the developer receiving opening closed, and therefore, preventing the developer from moving back into the cradle 7*a* from inside the main assembly of the image forming apparatus.

The apparatus shutter 8 is also provided with a pair of engaging portions 8*a* which engage with the pair of snap-lock portions 6 of the developer supply container 1, during the developer supply operation of the developer supply container 1.

<Developer Supply Operation>

Next, referring to FIGS. 5(*a*) and 5(*b*) and FIGS. 6(*a*)-6(*c*), the operation for supplying the developer to the main assembly of the image forming apparatus with toner, with the use of the developer supply container 1 and developer receiving apparatus 7 in First Embodiment, will be described.

First, the developer supply container 1 is to be mounted into the developer receiving apparatus 7 from the direction indicated by an arrow F. When the developer supply container 1 is mounted, it is placed in such a state that the developer supply opening 1*b* of the developer supply container 1 is covered with the apparatus shutter 8 and is located at a position apart from the developer receiving opening 7*b* closed (covered) with the apparatus shutter 8 (herein, this position is referred to as a "removal position"). The developer supply container 1 located at the removal position is constituted so that it can be removed from the developer receiving apparatus 7.

Figure 5:
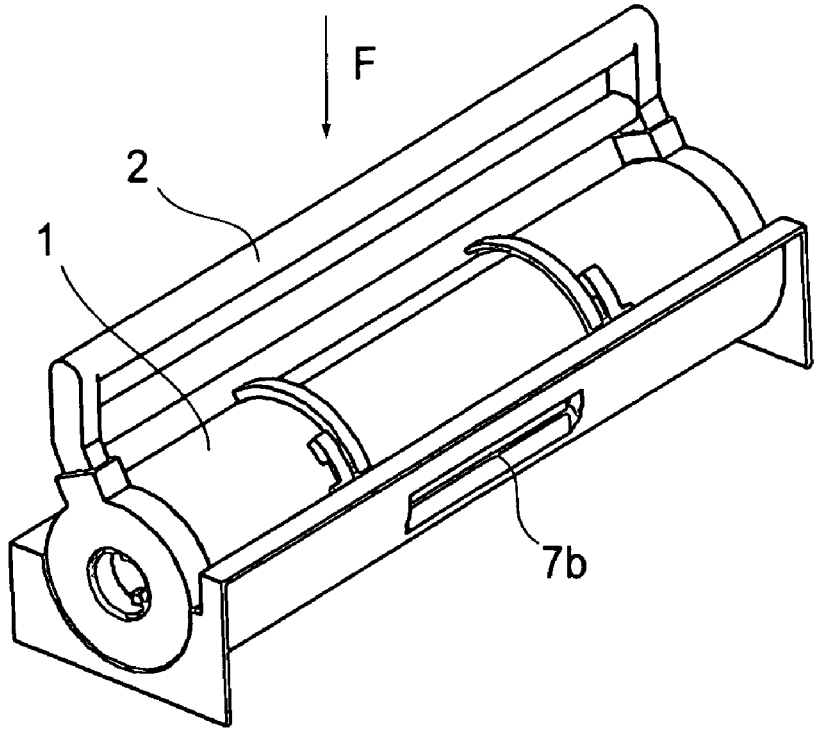
FIGS. 5(*a*) and 5(*b*) are perspective views of the developer supply container in the First Embodiment of the present invention, showing the state of the developer supply container immediately after mounting thereof into the developer receiving apparatus, and after rotation thereof by its handle after the mounting, respectively.
Figure 5:
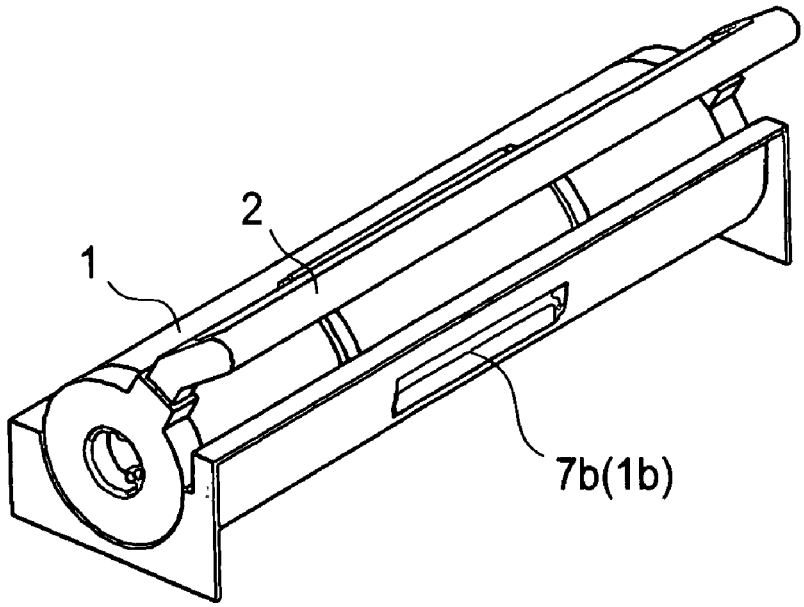

The container shutter 3 is placed in such a state that it is prevented by the stopper 7*d* from rotationally moving in the circumferential direction of the container body 1*a* (FIGS. 5(*a*) and 6(*a*)).

Figure 6:
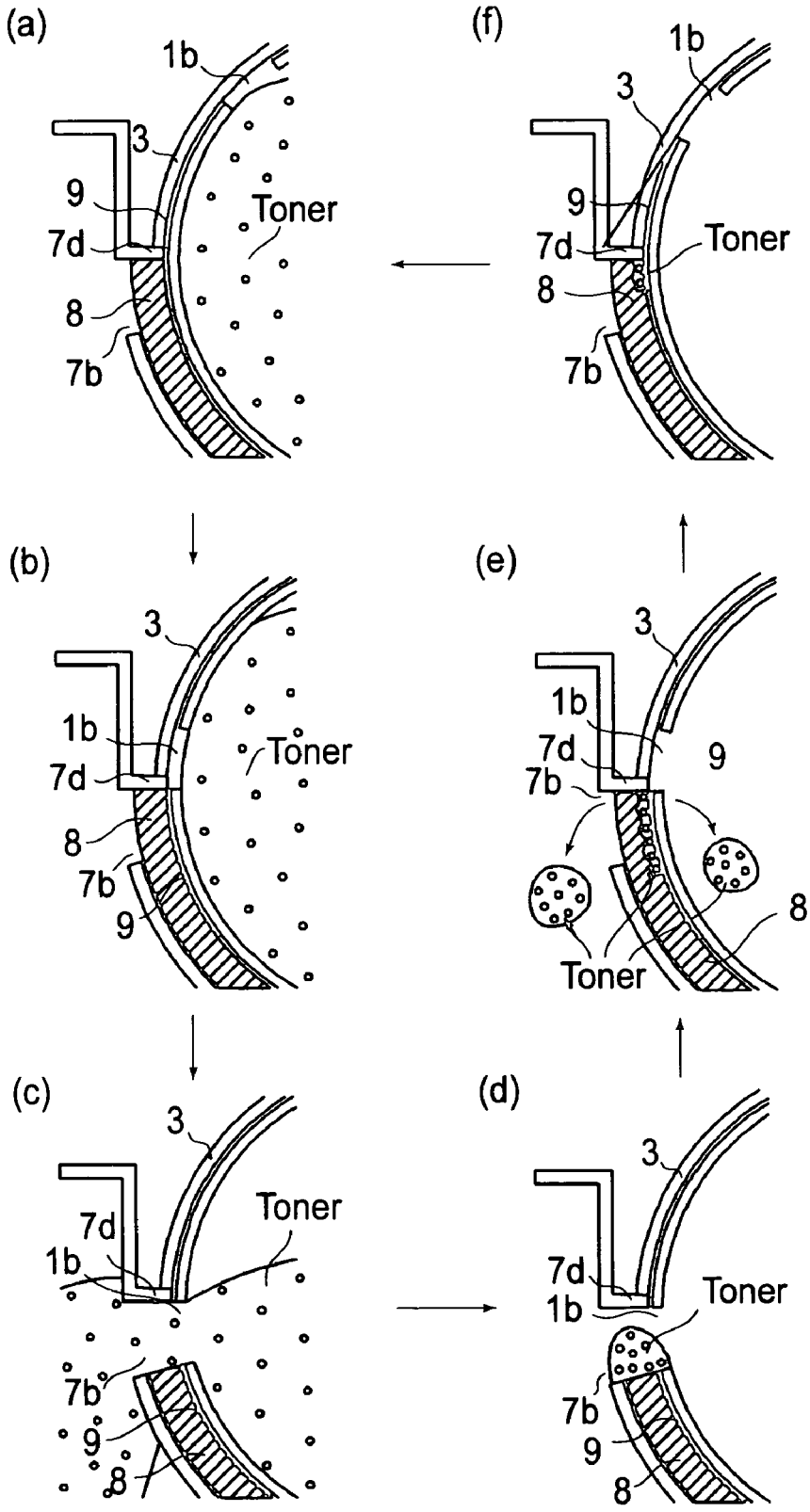
FIG. 6(*a*) to 6(*f*) are side sectional views showing states of the developer supply container in a developer supply operation in First Embodiment, wherein 6(*a*) is the state immediately after mounting thereof, 6(*b*) is the state during rotation thereof, 6(*c*) is the state during supply of the developer, 6(*d*) is the state after completion of the supply of the developer, and 6(*e*) and 6(*f*) are the states during the rotation of the developer supply container.

Next, when the user rotates the handle 2 in a counterclockwise direction (in FIG. 6(*a*) or the arrow F direction in FIG. 5(*a*)) as seen in an axial direction from the developer filling opening 1*c* side, the container shutter 3 is not rotated due to regulation by the stopper 7*d* but only the developer supply container 1 is rotated. When the developer supply container 1 is further rotated, the snap-lock portion 6 is engaged with the engaging developer 8*a* of the apparatus shutter 8 substantially simultaneously with exposure of a lower edge of the developer supply opening 1*b* from a lower edge of the container shutter 3 (FIG. 6(*b*)).

More specifically, the apparatus shutter 8 is stopped and the developer supply container is rotated relative to the apparatus shutter 8 in a period from a time of start of rotation of the developer supply container (FIG. 6(*a*)) to a time of engaging and connecting the snap-lock portion 6 with the apparatus shutter 8. As described hereinafter, during the relative rotation of the developer supply container to the apparatus shutter, the sealing member 9 is constituted so that it can clean the apparatus shutter 8 by sliding on the surface of the apparatus shutter 8.

When the developer supply container 1 is further rotated, the apparatus shutter 8 is interlocked with the developer supply container 1 by the engagement with the snap-lock portion 6 to be rotated, so that the developer receiving opening 7*b* is opened, thus finally communicating with the developer supply opening 1*b* (FIG. 5(*b*) and FIG. 6(*c*)). Such a communication position where the developer supply opening 1*b* and the developer receiving opening 7*b* communicate with each other is referred to as a "supply position". At the supply position, a driving force from the main assembly of the image forming apparatus is transmitted to the stirring member 4 through the driving gear member 5, thus permitting discharge of the developer.

After the completion of the supply of the developer from the developer supply container 1, the developer accumulated on the lower edge of the developer receiving opening 7*b* during the supply of the developer from the developer supply container 1 is placed in such a state that it remains as it is (FIG. 6(*d*)).

In this state, when the user rotates the handle 2 in a clockwise direction (in FIG. 6(*d*)) as seen in the axial direction from the developer filling opening 1*c* side, the apparatus shutter 8 is interlocked with the developer supply container 1 by the engagement with the snap-lock portion 6 while keeping such a positional relationship that its upper edge is substantially aligned with the lower edge of the developer supply opening 1*b*, thus being rotated to close (seal) the developer receiving opening 7*b*. At that time, most of the above described accumulated is recovered in the image forming apparatus main assembly or the container body 1*a* but unrecovered developer enters a gap between the developer supply container 1 and the apparatus shutter 8, so that there is possibility that the developer is slightly deposited on an internal surface of the apparatus shutter 8 (FIG. 6(*e*)).

In this embodiment, however, the sealing member 9 is constituted so that the accumulated developer is wiped and removed by the sealing member 9. More specifically, the developer supply container 1 of this embodiment is further rotated from the state shown in FIG. 6(*e*), whereby the apparatus shutter 8 is placed in such a state that the developer receiving opening 7*b* is completely closed, and the upper edge of the apparatus shutter 8 is regulated so as not to be rotationally moved excessively. For this reason, when the developer supply container 1 is further rotated from the state shown in FIG. 6(*e*), the engagement of the apparatus shutter 8 with the snap-lock portion 6 is released, so that the developer supply container 1 is separated from the apparatus shutter 8 to be rotated relative to the apparatus shutter 8. In this case, the sealing member 9 is disposed to slide on the inner peripheral surface of the apparatus shutter 8. As a result, the surface of the apparatus shutter 8 is cleaned by the sliding of the sealing member 9. In other words, the developer deposited on the surface of the apparatus shutter 8 is recovered by the sealing member 9 (FIG. 6(*f*)).

When the developer supply container 1 is further rotated, the developer supply container is returned to the state shown in FIG. 6(*a*), i.e., the removal position. At this position, the developer supply container 1 is in such a state that a further rotation thereof is regulated. In such a state, the user can remove the developer supply container 1 from the developer receiving apparatus 7. Thereafter, the user mounts a new developer supply container into the developer receiving apparatus 7 and performs the setting operation from the removal position to the supply position, thus completing a sequence of the developer supply operation.

At the time when the developer supply container is removed, the developer is little deposited on the surface of the apparatus shutter 8. Accordingly, even in such a constitution that the apparatus shutter 8 exposed when the developer supply container 1 is removed from the developer receiving apparatus 7, the user can mount the developer supply container 1 without concern for scattering of the developer. Further, when the new developer supply container is mounted, it is possible to suppress contamination with the developer at an outer surface of the developer supply container by contact with the apparatus shutter. As described above, according to this embodiment, it is possible to clean the apparatus shutter in both of steps including an unsealing (opening) step for rotationally moving the developer supply container from the removal position to the supply position and a re-sealing (closing) step for rotationally moving the developer supply container from the supply position to the removal position. Incidentally, in this embodiment, the sealing member 9 on which the developer is deposited in completely covered with the container shutter 3, so that the developer is not deposited on fingers of the user when the user touches the developer supply container after the removal.

In this embodiment, a phase of communication of the developer supply container 1*b* with the developer receiving opening 7*b* is taken in the horizontal direction (FIG. 6(*c*)) but may be located downstream from the substantially horizontal direction. Thus, an amount of the above described accumulated developer is decreased, so that it is possible to expect the effect of improving the contamination with developer.

As described above, when the developer receiving opening 7*b* is closed by the apparatus shutter 8 from such a state that it communicates with the developer supply opening 1*b* by opening the apparatus shutter 8, the sealing member 9 is moved relative to the apparatus shutter 8 while sliding on the peripheral surface of the apparatus shutter 8. As a result, it becomes possible to obviate such a phenomenon that contamination with developer of the outer surface of the developer supply container 1 and the surface of the apparatus shutter 8 as much as possible.

Further, together with the resealing operation of the developer supply opening 1*b* or the developer receiving opening 7*b*, the wiping cleaning of the apparatus shutter 8 with the sealing member 9 is performed, so that the resultant constitution is simpler than that employing these operations performed separately from each other. In other words, the cleaning of the apparatus shutter is automatically performed only by performing the rotational movement of the developer supply container for resealing by the user, so that it can be said that usability is high.

By employing such a constitution that at least a part of the sealing member 9 is covered with the container shutter 3 when the developer supply opening 1*b* is closed by the container shutter 3, it becomes possible to prevent the deposition of developer on hand(s) of the user when the user touches the developer supply container 1 after the developer supply container 1 is removed from the developer receiving apparatus 7.

Further, the sealing member 9 is disposed at least upstream from the developer supply opening 1*b* in a moving direction for resealing the developer supply container 1, so that it becomes possible to wipe the developer, which has not been recovered into the developing apparatus or the container body, with the sealing member 9.

Second Embodiment

Next, an image forming apparatus according to Second Embodiment will be described with reference to FIGS. 7(*a*) and 7(*b*). Incidentally, a basic constitution of the apparatus of this embodiment is the same as in First Embodiment described above, so that repetitive explanation thereof is omitted, and explanation is made with respect to a constitution characterizing this embodiment. Members or means having the same functions as those described in the above described embodiment are represented by the same referential numbers or symbols.

Figure 7:
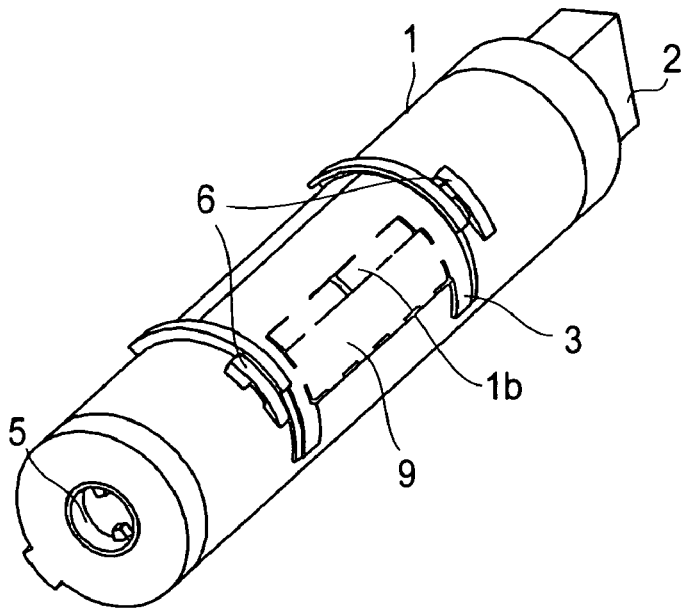
FIGS. 7(*a*) and 7(*b*) are perspective views, wherein 7(*a*) shows a developer supply container in Second Embodiment, and 7(*b*) shows a developer receiving apparatus in Second Embodiment.
Figure 7:
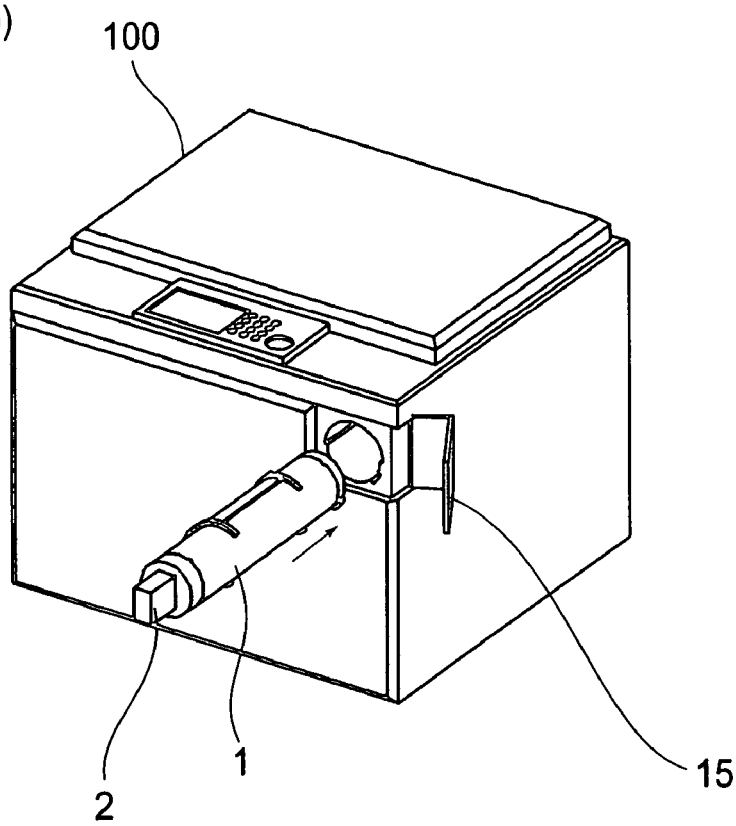

A developer supply container 1 in this embodiment is, as shown in FIG. 7(*a*), constituted so that it is mounted into a main assembly 100 of an image forming apparatus from a front side of the apparatus. More specifically, different from First Embodiment, a handle 2 is provided at an end, of a container body 1*a* in a lengthwise direction of the container body 1*a*, opposite to an end to which a drive gear member 5 is provided. Further, as shown in FIG. 7(*b*), a cover 15 for replacing the developer supply container 1 has a mechanism for opening or closing the cover 15 toward the outside of the apparatus, so that a user mounts the developer supply container 1 into the main assembly 100 of the image forming apparatus by inserting it with the drive gear member 5 as a leading end along a lengthwise direction of the developer supply container 1 while holding the handle 2.

In this embodiment, such a constitution that developer is supplied by rotating the developer supply container 1 with the handle 2 after the insertion so as to align the developer supply opening 1*b* with the developer receiving opening 7*b* as described above and after the supply of the developer, the developer supply container 1 is rotated in an opposite direction to that at the time of mounting the developer supply container 1 so as to seal (close) the developer supply opening 1*a* and the developer receiving opening 7*b* with the container shutter 3 and the apparatus shutter 8, respectively, to be removed from the apparatus is employed.

Even in such a constitution, by rotating the developer supply container 1 when the developer supply container 1 is removed, the sealing member 9 slides on the inner peripheral surface of the apparatus shutter 8, so that developer accumulated on an upper edge of the apparatus shutter 8 can be wiped off.

Third Embodiment

Figure 8:
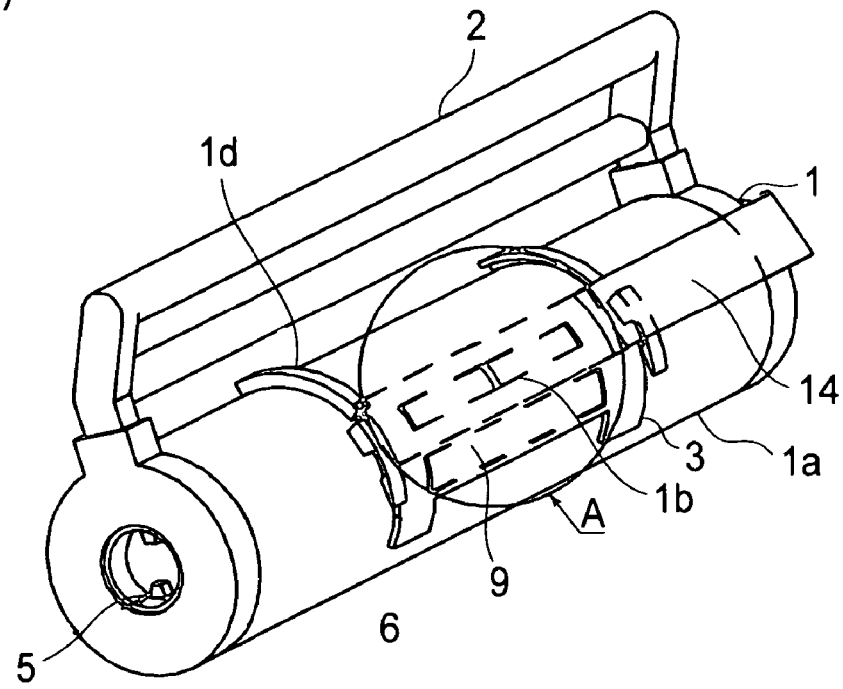
FIGS. 8(*a*) and 8(*b*) are perspective views, wherein 8(*a*) shows a developer supply container in Third Embodiment, and 8(*b*) shows an enlarged view of the portion A (from which a container shutter 3 is omitted) in 8(*a*).
Figure 8:
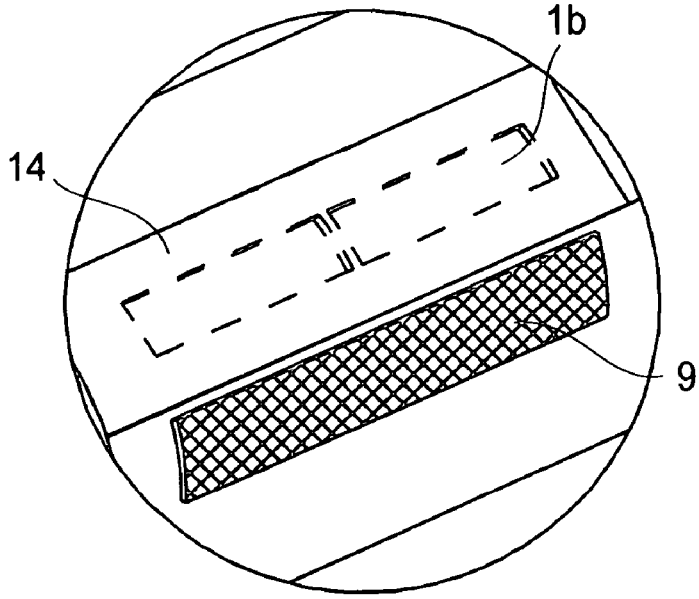

Next, an image forming apparatus according to Third Embodiment will be described with reference to FIGS. 8(*a*) and 8(*b*) and FIGS. 9(*a*) to 9(*f*). Incidentally, a basic constitution of the apparatus of this embodiment is the same as in First Embodiment described above, so that repetitive explanation thereof is omitted, and explanation is made with respect to a constitution characterizing this embodiment. Members or means having the same functions as those described in the above described embodiments are represented by the same referential numbers or symbols.

In First embodiment described above, such a constitution that the developer supply opening 1*b* is sealed with only the container shutter 3 is employed. In this embodiment, however, a constitution in which the developer supply opening 1*b* is sealed with a sealing film 14 and is further covered with the container shutter 3 as shown in FIG. 8(*a*) is employed in order to improve a sealing property of the developer supply opening 1*b*. For this reason, as shown in FIG. 8(*b*), the sealing member 9 is disposed apart from the developer supply opening 1*b* so as to avoid an adhesion portion of the sealing film 14. The sealing film 14 has an adhesion portion adhered to a periphery of the developer supply opening 1*b* and an extending portion extending from the adhesion portion. The extending portion is folded back at one end of the sealing film 14 and extends toward the other end of the sealing film 14. The user grasps and pulls the other end of the sealing film 14, whereby the sealing film 14 can be readily peeled off.

Figure 9:
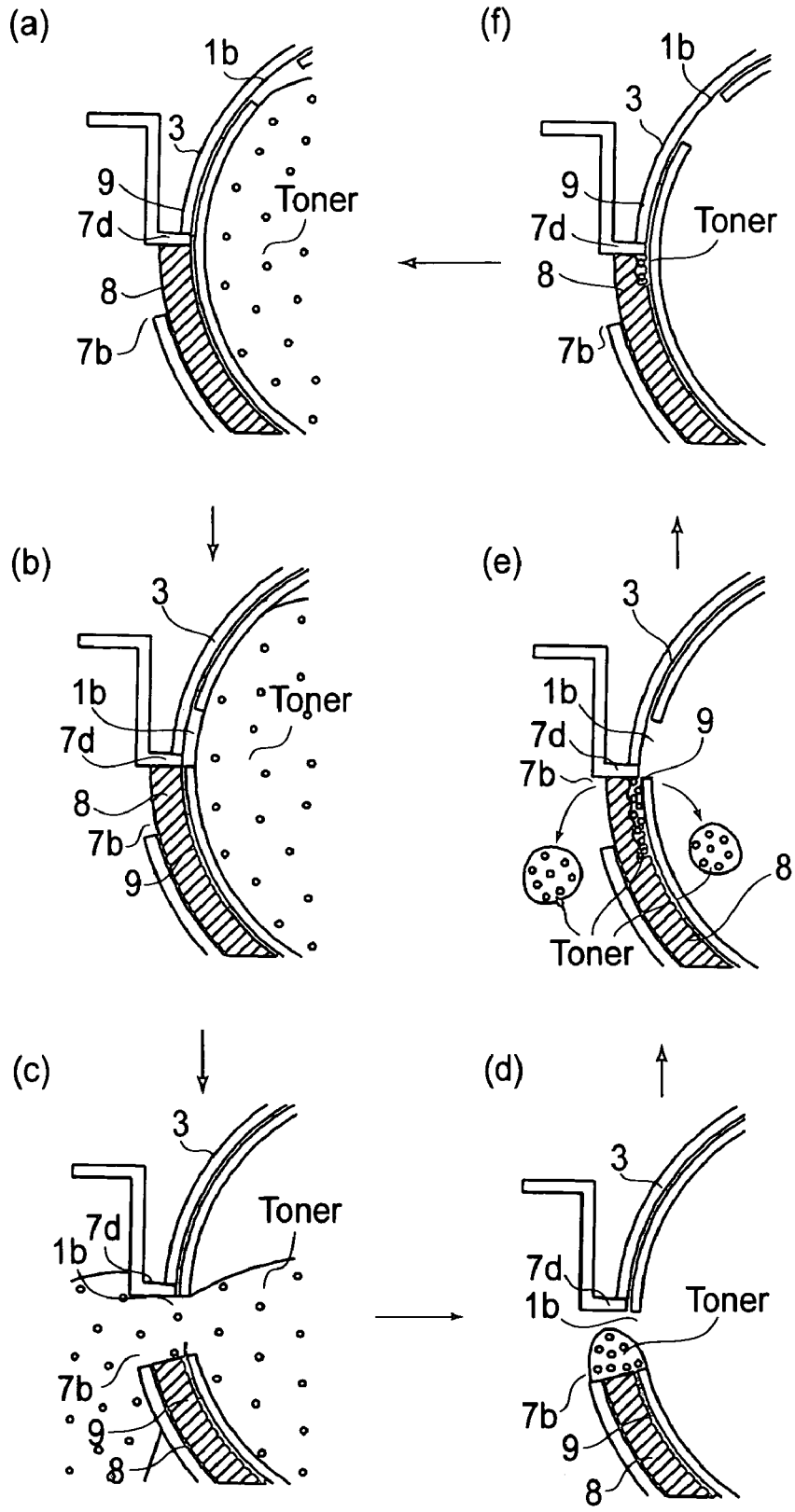
FIG. 9(*a*) to 9(*f*) are side sectional views showing states of the developer supply container in a developer supply operation in Third Embodiment, wherein 9(*a*) is the state immediately after mounting thereof, 9(*b*) is the state during rotation thereof, 6(*c*) is the state during supply of the developer, 9(*d*) is the state after completion of the supply of the developer, and 9(*e*) and 9(*f*) are the states during the rotation of the developer supply container.

FIGS. 9(*a*) to 9(*f*) show a developer operation using the developer supply container 1 and the developer receiving apparatus 7 in Third Embodiment. First, when the developer supply container 1 is mounted into the developer receiving apparatus 7 and thereafter the user peeled off the sealing film 14, a sealing film gap is created at a position where the sealing film 14 has been disposed (FIG. 9(*a*)).

Then, when the developer supply container 1 is rotated in a counterclockwise direction on the drawing, similarly as in First Embodiment, the developer supply opening 1*b* and the developer receiving opening 7*b* finally communicate with each other (FIGS. 9(*b*) and 9(*c*)), but in this state, the developer enters the sealing film gap when the developer is supplied from the developer supply container 1 to the developer receiving apparatus 7. As a result, after the completion of the supply of the developer from the developer supply container 1, the developer accumulated during the supply from the developer supply container 1 remains not only on a lower edge of the developer receiving opening 7*b* but also in the sealing film gap (FIG. 9(*d*)).

In this state, when the developer supply container is rotated in a clockwise (opposite) direction on the drawing, similarly as in First Embodiment, unrecovered developer on the lower edge of the developer receiving edge enters a spacing between the developer supply container 1 and the apparatus shutter 8, so that an amount of developer deposited on the inner surface of the apparatus shutter 8 is increased when an amount of developer accumulated in the sealing film gap is added thereto. For this reason, there is a possibility that a contamination with developer is worsen (FIG. 9(*e*)).

However, also in this embodiment, thereafter, the developer supply container 1 is separated from the apparatus shutter 8, and is rotated relative to the apparatus shutter 8 so as to slide on the inner peripheral surface of the apparatus shutter 8. Due to sliding therebetween, the developer deposited on the surface of the apparatus shutter 8 is removed by the sealing member 8 with reliability (FIG. 9(*f*)).

When the developer is filled in the above constituted developer supply container 1, which is then mounted to the developer receiving apparatus 7 and removed therefrom after the supply of developer, the developer contamination of the developer supply container 1 and the developer receiving apparatus 7 can be little confirmed. Accordingly, according to this embodiment, it could be confirmed that the developer contamination during mounting and demounting of the developer supply container could be suppressed to a minimum level.

Fourth Embodiment

Next, an image forming apparatus according to Fourth Embodiment will be described with reference to FIGS. 10(*a*) to 10(*f*). Incidentally, a basic constitution of the apparatus of this embodiment is the same as in First Embodiment described above, so that repetitive explanation thereof is omitted, and explanation is made with respect to a constitution characterizing this embodiment. Members or means having the same functions as those described in the above described embodiments are represented by the same referential numbers or symbols.

Figure 10:
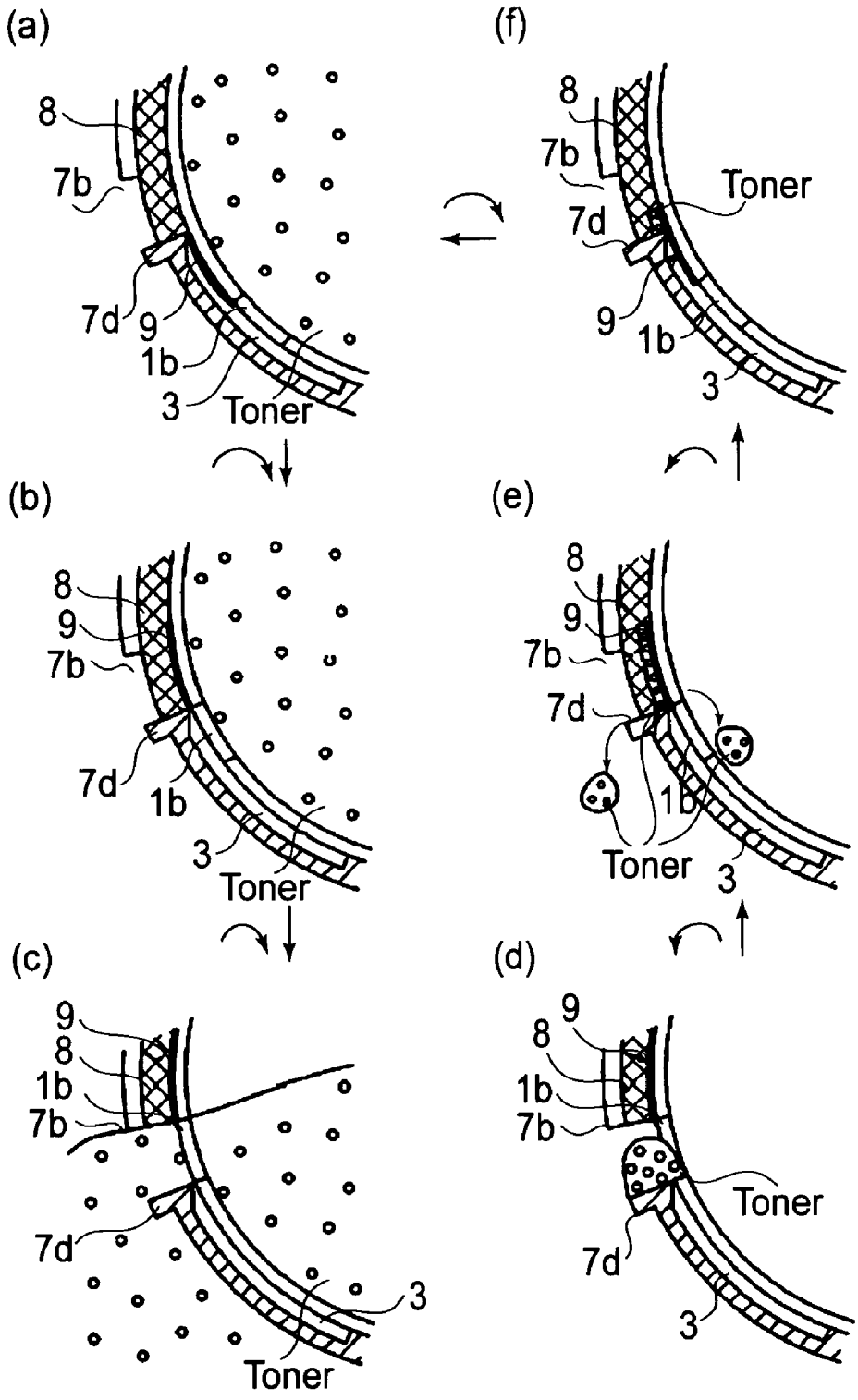
FIG. 10(*a*) to 10(*f*) are side sectional views showing states of the developer supply container in a developer supply operation in Fourth Embodiment, wherein 10(*a*) is the state immediately after mounting thereof, 10(*b*) is the state during rotation thereof, 10(*c*) is the state during supply of the developer, 10(*d*) is the state after completion of the supply of the developer, and 10(*e*) and 10(*f*) are the states during the rotation of the developer supply container.

In this embodiment, a developer supply operation is performed in such a manner that the developer supply container 1 is mounted into the developer receiving apparatus 7 at a rotation phase positioned at a level lower than the developer supply opening 7*b* (FIG. 10(*a*)), and the developer supply container 1 is rotated in a clockwise direction, (on the drawing) as seen in an axial direction of the developer filling opening 1*c* side, opposite to that in First Embodiment to communicate with the apparatus shutter 8 (FIGS. 10(*b*) and 10(*c*)).

After the completion of the supply of the developer from the developer supply container 1, the developer accumulated during the supply from the developer supply container 1 remains on a lower edge of the developer receiving opening 7*b* (FIG. 10(*d*)).

In this state, when the developer supply container is rotated in a clockwise (opposite) direction on the drawing to seal (close) the developer supply opening, similarly as in First Embodiment, unrecovered developer on the lower edge of the developer receiving edge enters a spacing between the developer supply container 1 and the apparatus shutter 8, thus depositing on the surface of the apparatus shutter 8 in some cases (FIG. 10(*e*)).

However, also in this embodiment, when the developer supply container 1 is further rotated from the state of FIG. 10(*e*) similarly as in the case of First Embodiment, the developer supply container 1 is rotated relative to the apparatus shutter 8 so as to slide on the inner peripheral surface of the apparatus shutter 8. Due to sliding therebetween, the developer deposited on the surface of the apparatus shutter 8 is wiped off by the sealing member 8 with reliability (FIG. 10(*f*)).

When the developer is filled in the above constituted developer supply container 1, which is then mounted to the developer receiving apparatus 7 and removed therefrom after the supply of developer, the developer contamination of the developer supply container 1 and the developer receiving apparatus 7 can be little confirmed. Accordingly, according to this embodiment, it could be confirmed that the developer contamination during mounting and demounting of the developer supply container could be suppressed to a minimum level.

Fifth Embodiment

Next, an image forming apparatus according to Fifth Embodiment will be described with reference to FIGS. 11(*a*) to 11(*d*). Incidentally, a basic constitution of the apparatus of this embodiment is the same as in First Embodiment described above, so that repetitive explanation thereof is omitted, and explanation is made with respect to a constitution characterizing this embodiment. Members or means having the same functions as those described in the above described embodiments are represented by the same referential numbers or symbols.

The developer supply container 1 of this embodiment is constituted so that the developer supply opening 1*a* and the developer receiving opening 7*b* are opened or closed by linearly moving the developer supply container 1 in a vertical direction.

Figure 11:
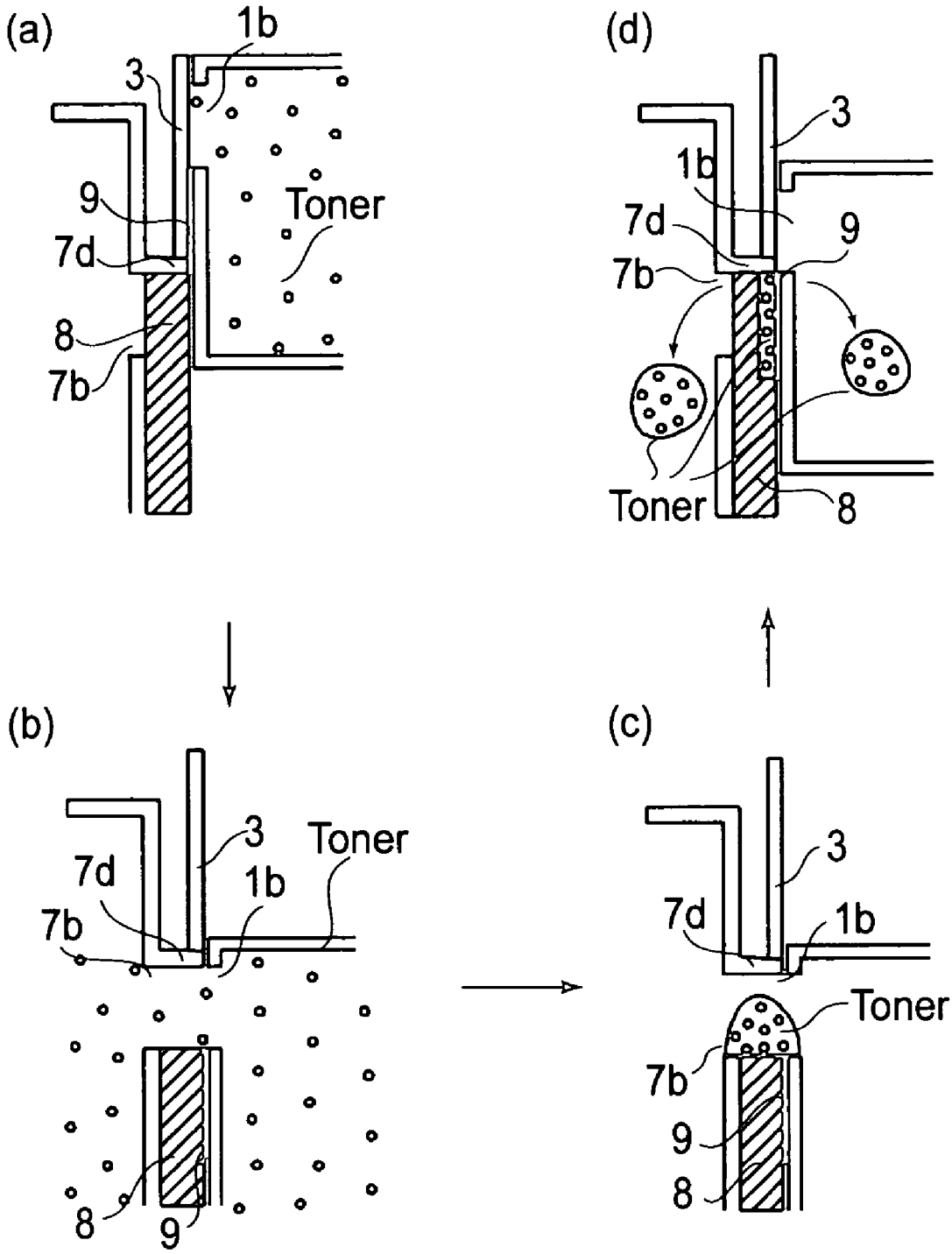
FIG. 11(*a*) to 11(*d*) are side sectional views showing states of the developer supply container in a developer supply operation in Fifth Embodiment, wherein 11(*a*) is the state immediately after mounting thereof, 11(*b*) is the state during supply of the developer, 11(*c*) is the state after completion of the supply of the developer, and 11(*d*) is the states during movement of the developer supply container.

A developer supply operation in this embodiment is performed by using the developer supply container 1 and the developer receiving apparatus 7 as shown in FIGS. 11(*a*) to 11(*d*). First, the developer supply container 1 is mounted into the developer receiving apparatus 7 from above the developer receiving apparatus 7 (FIG. 11(*a*)). Thereafter, the developer supply container 1 is moved downward, similarly as in First Embodiment, the developer supply opening 1*b* finally communicate with the developer receiving opening 7*b* (FIG. 11(*b*)).

After completion of supply of developer from the developer supply container 1, developer accumulated during the supply of developer remains on a lower edge of the developer receiving opening 7*b* (FIG. 11(*c*)).

In this state, when the developer supply container 1 is moved upward (in an opposite direction), similarly as in First Embodiment, unrecovered developer on the lower edge of the developer receiving opening 7*b* enters a spacing between the developer supply container 1 and the apparatus shutter 8 (FIG. 11(*d*)).

Also in this embodiment, however, the developer supply container 1 is separated from the apparatus shutter 8 and is moved relative to the apparatus shutter 8, so that the sealing member 9 is moved relative to the apparatus shutter 8 so as to slide on the inner peripheral surface of the apparatus shutter 8. Due to sliding therebetween, the developer deposited on the surface of the apparatus shutter 8 is removed by the sealing member 9 with reliability.

Sixth Embodiment

Figure 12:
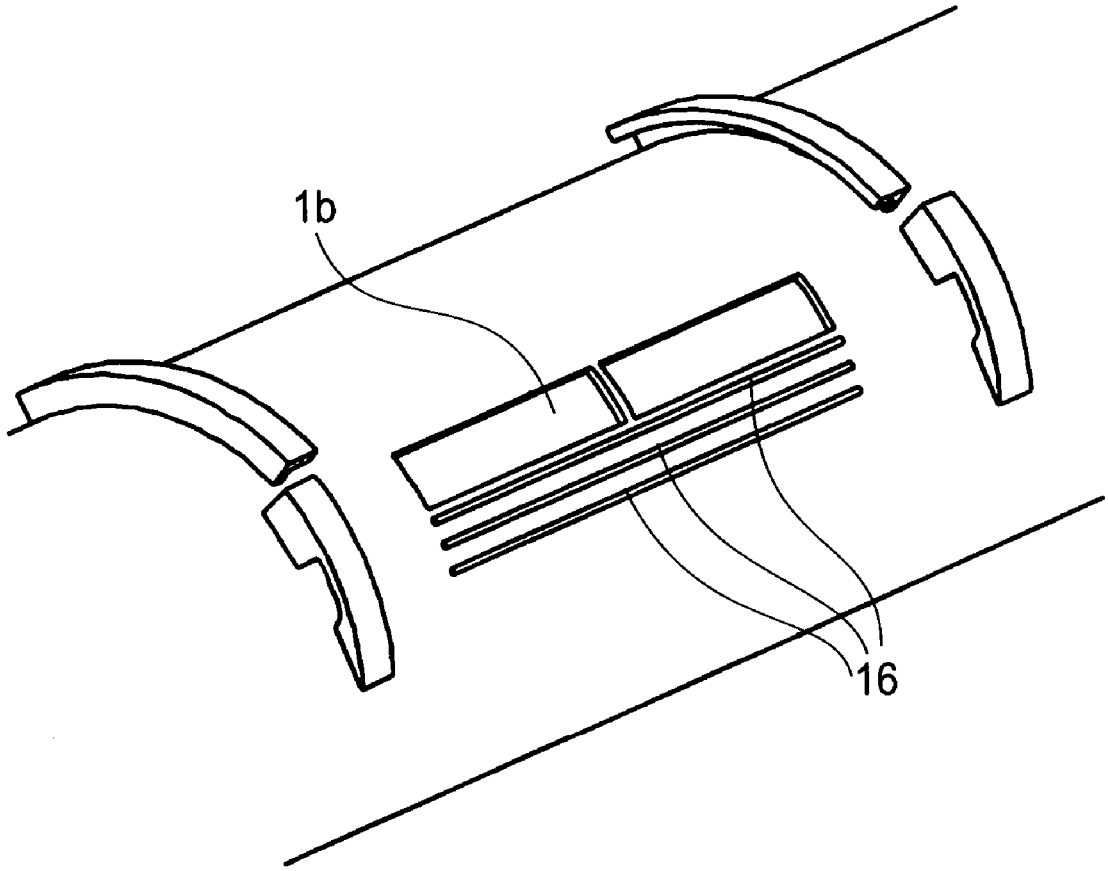
FIG. 12 is an enlarged view (from which a container shutter 3 is omitted) of a developer supply container in Sixth Embodiment of the present invention.

Next, an image forming apparatus according to Sixth Embodiment will be described with reference to FIG. 12. Incidentally, a basic constitution of the apparatus of this embodiment is the same as in First Embodiment described above, so that repetitive explanation thereof is omitted, and explanation is made with respect to a constitution characterizing this embodiment. Members or means having the same functions as those described in the above described embodiments are represented by the same referential numbers or symbols.

The developer supply container 1 of this embodiment is prepared by integrally forming a container body 1 with a rib member 16 which is disposed in the neighborhood of the developer supply opening 1*b* on a peripheral surface of the container body 1. The rib member 16 is set to have a length longer than a width (length) of the developer supply opening 1*b* in a lengthwise direction of the developer supply opening 1*b* similarly as in the case of the sealing member 9 in First to Fifth Embodiments, and is provided on the container body 1 at a position upstream from the developer supply opening 1*b* in a rotational movement direction of the developer supply container 1 during an operation of the developer supply container 1 after the supply operation of the developer. Further, the rib member 16 is constituted so that it slides on the surface of the apparatus shutter 8 during the mounting or demounting operation of the developer supply container 1. Even in the above described constitution, the rib member 16 slides on the inner peripheral surface of the apparatus shutter 8, thus wiping off the developer accumulated on an upper edge of the apparatus shutter 8.

Incidentally, the rib member 16 has a rigidity similar to that of the container body 1*a*, so that a sliding load thereof on the inner peripheral surface of the apparatus shutter 8 is increased (i.e., poor usability). For this reason, similarly as in First to Fifth Embodiments, the cleaning member may preferably be an elastic member.

Seventh Embodiment

Figure 13:
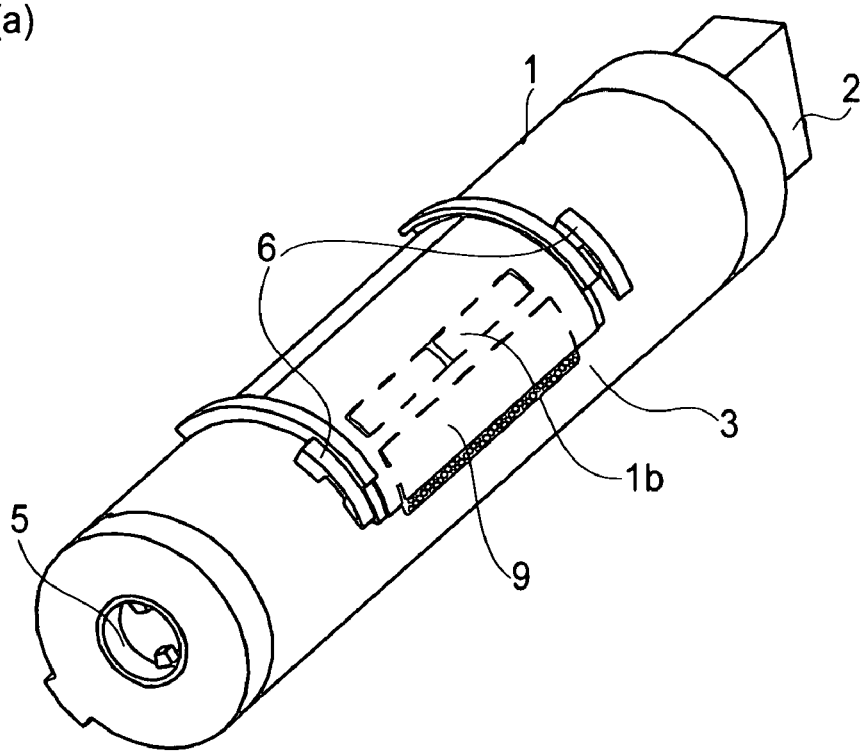
FIGS. 13(*a*) and 13(*b*) are perspective views, wherein 13(*a*) shows a developer supply container in Seventh Embodiment, and 13(*b*) shows a state during removal of a developer receiving apparatus in Seventh Embodiment.
Figure 13:
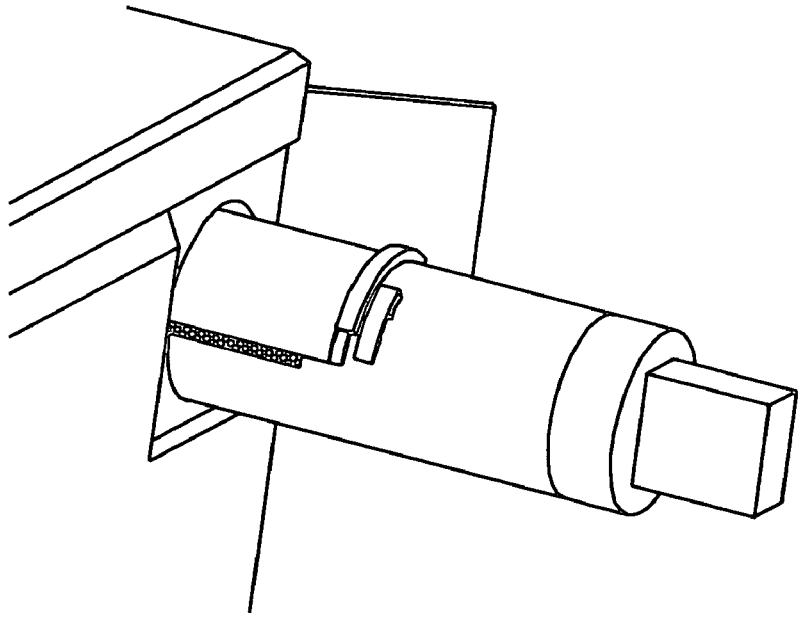

Next, an image forming apparatus according to Seventh Embodiment will be described with reference to FIGS. 13(*a*) and 13(*b*). Incidentally, a basic constitution of the apparatus of this embodiment is the same as in First Embodiment described above, so that repetitive explanation thereof is omitted, and explanation is made with respect to a constitution characterizing this embodiment. Members or means having the same functions as those described in the above described embodiments are represented by the same referential numbers or symbols.

The basic constitution of the developer supply container 1 of this embodiment is substantially the same as that in Second Embodiment described with reference to FIGS. 7(*a*) and 7(*b*) except for the following point.

This embodiment is characterized in that the sealing member 9 of the developer supply container 1 is not completely covered with the apparatus shutter 8 after the developer supply operation, i.e., at the time when the developer supply container 1 is rotationally moved from the supply position to the removal position.

The reason why a part of the sealing member 9 is exposed when the developer supply container 1 is located at the removal position is that developer slightly deposited in the neighborhood of the upper edge of the apparatus shutter 8 is wiped off by utilizing the sliding operation during the removal of the developer supply container 1. More specifically, this is because the apparatus shutter 8 is constituted so as to be reclosed by running against the stopper 7*d*, so that a slight amount of developer remains between the apparatus shutter 8 and the stopper 7*d* in some cases. As a result, there is a possibility that the neighborhood of the area is contaminated.

For these reasons, only a portion sliding on the neighborhood of the area in which the apparatus shutter 8 runs against the stopper 7*d* is exposed during the removal of the developer supply container 1. According to this embodiment, it is possible to wipe off the developer, remaining in the neighborhood of the area in which the apparatus shutter 8 runs against the stopper 7*d*, by the sealing member 9 even during the mounting operation of the developer supply container 1 into the developer receiving apparatus 7 (during the sliding operation).

Other Embodiments

In the above described embodiments, the container body of the developer supply container is roughly cylindrical. However, the embodiments are not intended to limit the scope of the present invention in terms of the configuration of the container body. In other words, the container body may be different in configuration from those in the above described embodiments, as long as it can store developer.

Further, in the above described embodiments, such a constitution that a setting operation of the developer supply container from the removal position to the supply position by rotationally moving the developer supply container but the present invention is not limited to such a constitution. For example, the developer supply container is designed o have a double structure having an external cylinder and an internal cylinder so that the external cylinder functions as the container shutter and the internal cylinder functions as the developer containing portion provided with a stirring member 4 thereon. More specifically, the external cylinder has the same structure as the container body described in Embodiments 1-7 mentioned above, and the internal cylinder is provided with an internal cylinder opening capable of communicating with the developer supply opening 1*b* provided to the external cylinder. Further, the internal cylinder is provided with the snap-lock portion 6, the sealing member 9, the handle 2, etc., in addition to the internal cylinder opening. Incidentally, the internal cylinder is fixed to the developer receiving apparatus in a substantially rotational load state at the time when the developer supply container is mounted into the developer receiving apparatus. In this state, the internal cylinder opening is in such a state that it is located opposite to the developer receiving opening 7*b* via the apparatus shutter 8 and the external cylinder. On the other hand, the developer supply container is mounted so that the developer supply opening 1*b* of the external cylinder is directed upward. Thereafter, similarly as in the constitution of the container body described in Embodiments 1-7 mentioned above, the external cylinder is rotationally moved to the developer supply position at which the developer supply opening 1*b* communicates with the developer receiving opening 7*b*. After the completion of supply of developer, the external cylinder is rotationally moved to the removal position in an opposite direction to the direction toward the developer supply position, thus permitting the removal of the developer supply container.

Also in the above described embodiments, the image forming apparatus was a copying machine. However, the present invention is also applicable to various image forming apparatuses other than a copying machine, as long as they form an image with the use of developer. For example, the present invention is applicable to such an image forming apparatus as a printer, a facsimileing machine, a multifunction image forming apparatus capable of two or more functions of these apparatuses. It also is applicable to an image forming apparatuses which comprises a transfer material bearing member, such as a transfer material conveyance belt, a transfer drum, etc., for holding a transfer material in the form of a sheet or the like, and form an image on the transfer material by sequentially laying multiple developer images different in color on the transfer material. It also is applicable to an image forming apparatuses which comprise an intermediary transferring member, such as an intermediary transfer belt, an intermediary transfer drum, etc., and forms an image on the transfer material by sequentially transferring multiple developer images different in color, onto the intermediary transfer member, and then, transferring all at once the multiple developer images having been transferred in layers on the intermediary transferring member, onto the transfer medium. The application of the present invention to these image forming apparatuses achieves the same effects as those achieved by the image forming apparatus in the above described embodiments.

Further, the application of the present invention to a given image forming apparatus is not limited by the number of the developing apparatuses employed by the image forming apparatus. In other words, not only is the present invention applicable to an image forming apparatus having only one developing apparatus, but also, an image forming apparatus employing a plurality of developing apparatuses which are different in the color of the developer they use; the present invention is applicable to various image forming apparatuses regardless of the number of developing apparatuses they employ. The effects of the present invention remain the same whether the present invention is applied to an image forming apparatus having a single developing apparatus, or an image forming apparatus having multiple developing apparatuses.

Further, the application of the present invention is not limited to such a developer supply container as the developer supply containers, in the above described embodiments, which is removably mounted into the main assembly of an image forming apparatus. Further, the present invention is applicable to a developer supply container structured so that it can be removably mounted into the process cartridge (equivalent to developer receiving apparatus) as an image forming unit removably mounted in the main assembly of an image forming apparatus.

Incidentally, the abovementioned process cartridge means a cartridge in which the above described electrophotographic photosensitive member 104 as an image bearing member, and a minimum of one processing device among the charging device 203 which acts on this photosensitive member 104, developing device 201*a*, and cleaner 203, are integrally placed.

Comparative Embodiment

In this Comparative Embodiment, the developer supply container 1 is not provided with the sealing member 9 used in the above described embodiments of the present invention. Other constitutions of the developer supply container 1 and the developer receiving apparatus 7 are substantially the same as in those in the above described embodiments.

Supply of developer is performed after the above constituted developer supply container (comparative) 1 is mounted into the developer receiving apparatus 7. As a result, the developer enters a spacing between the developer supply container 1 and the apparatus shutter 8 and is deposited on the surfaces of the respective members. Thereafter, even when the developer supply container 1 is rotated after the deposition of developer, the deposited developer could not be wiped off since the sealing member 9 used in the above described embodiments was not provided. As a result, when the developer supply container 1 was removed, contamination with developer was caused to occur at the peripheral surfaces of the developer supply container 1 and the developer receiving apparatus 7.

On the other hand, in the above described embodiments, the deposited developer was wiped off by the sealing member 9, so that the contamination with developer at the outer surface of the apparatus shutter 8 could be obviated effectively.

These and other objects, features and advantages of the present invention will become more apparent upon a consideration of the following description of the preferred embodiments of the present invention taken in conjunction with the accompanying drawings.

This application claims priority from Japanese Patent Application No. 328682/2004 filed Nov. 12, 2004, which is hereby incorporated by reference.

What is claimed is:

1. A developer supply container detachably insertable into a developer receiving apparatus having a receiving opening for receiving developer and a shutter for opening and closing the receiving opening, said developer supply container comprising:

an engaging portion, provided on a periphery of said developer supply container, engageable with the shutter to open and close the shutter with a rotational movement about an axis of said developer supply container inserted in the developer receiving apparatus; and a cleaning member, provided on a periphery of said developer supply container, configured and positioned to clean the shutter with the rotational movement about the axis of said developer supply container.

2. A container according to claim 1, wherein said cleaning member is disposed to close a gap between said developer supply container and the developer receiving apparatus when the shutter is opened.

3. A container according to claim 2, wherein said cleaning member comprises an elastic body which is compressible between said developer supply container and the developer receiving apparatus when the shutter is opened.

4. A container according to claim 3, wherein the elastic body comprises nonwoven fabric.

5. A container according to claim 1, wherein said engaging portion comprises a snap-lock engagement portion for disengageable snap-lock engagement with the shutter by the rotational movement of said developer supply container to open and close the shutter.

6. A container according claim 1, further comprising:

a covering member configured and positioned to cover said cleaning member when said developer supply container is at a position where removal of said developer supply container from the developer receiving apparatus is permitted.

7. A developer supply container detachably insertable into a developer receiving apparatus having a receiving opening for receiving developer and a shutter for opening and closing the receiving opening, said developer supply container comprising:

a rotatable container body configured and positioned to contain the developer, said container body having a discharge opening permitting discharge of the developer contained in said container body;

an engaging portion, provided on a periphery of said container body, engageable with the shutter to open and close the shutter with a rotational movement about an axis of said container body inserted in the developer receiving apparatus between a removal position permitting removal of said developer supply container from the developer receiving apparatus and a developer supply position at which said discharge opening communicates with the receiving opening; and a cleaning member, provided on a periphery of said container body, configured and positioned to clean the shutter with the rotational movement about the axis of said container body.

8. A container according to claim 7, wherein said cleaning member is disposed downstream from said discharge opening in a direction of the rotational movement of said container body from the removal position to the developer supply position.

9. A container according to claim 7, wherein said cleaning member is disposed to close a gap between said developer supply container and the developer receiving apparatus when said container body is at the developer supply position.

10. A container according to claim 9, wherein said cleaning member comprises an elastic body which is compressible between said developer supply container and the developer receiving apparatus when said container body is at the developer supply position.

11. A container according to claim 10, wherein the elastic body comprises nonwoven fabric.

12. A container according to claim 7, wherein said cleaning member is disposed so as to surround said discharge opening.

13. A container according to claim 7, wherein said engaging portion comprises a snap-lock engagement portion for disengageable snap-lock engagement with the shutter by the rotational movement of said container body to open and close the shutter.

14. A container according to claim 7, further comprising:

a container shutter configured and positioned to open and close said discharge opening with the rotational movement of said container body, wherein said container shutter covers said cleaning member when said developer supply container is located at the removal position.

15. A container according to claim 1, wherein said engaging portion comprises an opening projection configured to open the shutter with the rotational movement of said developer supply container in a rotational direction and a closing projection configured to close the shutter with the rotational movement of said developer supply container in a rotational direction opposite to the rotational direction.

16. A container according to claim 7, wherein said engaging portion comprises an opening projection configured to open the shutter with the rotational movement of said container body from the removal position to the developer supply position and a closing projection configured to close the shutter with the rotational movement of said container body from the developer supply position to the removal position.

17. A container according to claim 12, further comprising:

a container shutter configured and positioned to open and close said discharge opening with the rotational movement of said container body, wherein said cleaning member comprises an elastic body which is covered by said container shutter and compressed between said container body and said container shutter when said container body is at the removal position.

* * * * *